United States Patent [19]

Kamrath

[11] Patent Number: 4,694,510

[45] Date of Patent: Sep. 22, 1987

[54] BIB WITH TEETHING SURFACE

[76] Inventor: Theresa K. Kamrath, Rt. 5, Box 35, Rice Lake, Wis. 54868

[21] Appl. No.: 734,862

[22] Filed: Jan. 30, 1986

[51] Int. Cl.[4] ..... A61J 17/00; A41D 13/10

[52] U.S. Cl. ..... 2/49 R; 128/359

[58] Field of Search ..... 2/49 R; 128/359; D24/45

[56] References Cited

U.S. PATENT DOCUMENTS 1,623,969 4/1927 Palmer ..... 128/359

2,595,462 5/1952 Johnson ..... 128/359

*Primary Examiner*—Doris L. Troutman

[57] ABSTRACT

A cloth bib having teething means on the bottom of the bib to enable a child to pick it up and bite on it.

1 Claim, 6 Drawing Figures

BIB WITH TEETHING SURFACE

This invention is a combination of a cloth bib and a rubber teether for use by babies and toddlers while they are teething to promote the growing of teeth. A cloth bib with a thickness of non-toxic rubber attached on the bottom to enable a child to pick it up and bite on. This will provide an excessible teether that is easy to find, grab and hold onto for the child.

In the accompanying drawing

FIG. 2 shows a back view,

Figure 1:
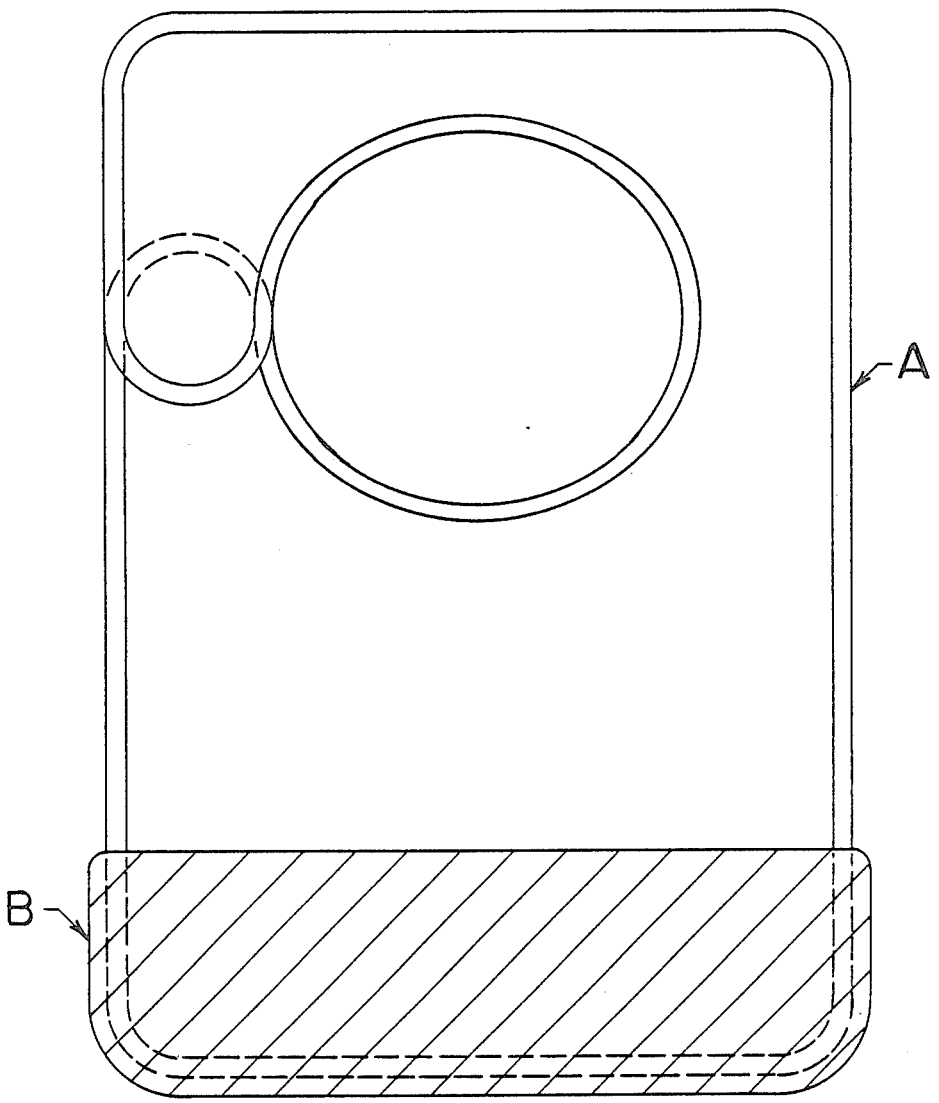
FIG. 1 is showing a front view of the bib.

FIG. 3 a side view,

FIG. 4 a neck cut-out,

FIG. 5 shows fabric tape attached along the entire edge of the bib,

FIG. 6 is VELCRO pieces for fastening the bib around the childs neck.

This bib can be made of any suitable material that is washable and may be provided with attractive illustraion or designs. The entire bib will be bound at the selvage by a fabric tape to prevent the edge from fraying. The teether that will be molded and sewed or snapped onto the bottom of the bib will be comparatively stiff, but of light weight so it can be worn around the neck comfortably. The bib can be fastened around the neck by any suitable means being ties, snaps, velcro or hooks.

Having thus described this invention, what is claimed is:

1. A teething bib for babies comprising a thickness of non-toxic rubber attached at the bottom of the bib on both front and back sides.

* * * * *